United States Patent [19]

Bordner

[11] Patent Number: 4,718,571

[45] Date of Patent: Jan. 12, 1988

[54] MOLDED LID ASSEMBLY WITH PRIMARY AND SECONDARY LATCHING FEATURES

[76] Inventor: Paul G. Bordner, 7803 Fairlawn Dr., Pickerington, Ohio 43147

[21] Appl. No.: 31,511

[22] Filed: Mar. 27, 1987

[51] Int. Cl.[4] ..... B65D 17/34

[52] U.S. Cl. ..... 220/270; 220/276; 220/306; 220/380; 215/256; 206/508

[58] Field of Search ..... 220/270, 276, 306, 380; 215/256; 206/508; 150/55

[56] References Cited

U.S. PATENT DOCUMENTS

| | | | |
|---|---|---|---|
| 4,457,447 | 7/1984 | Kirkis | 220/306 |
| 4,493,432 | 1/1985 | Smith | 220/270 |
| 4,574,974 | 3/1986 | Von Holdt | 220/306 |
| 4,660,735 | 4/1987 | Reschardt | 220/276 |

*Primary Examiner*—George T. Hall
*Attorney, Agent, or Firm*—Mueller and Smith

[57] ABSTRACT

A lid for use with containers such as drums, pails, tubs and cups which is formed as a singular unit from molded plastic and which incorporates a peripherally disposed skirt configured along with a rim structure to provide primary and secondary latching features. A parting groove is positioned within the skirt assembly in conjunction with a tear ring which functions to remove the primary latching assembly following the initial closure of the container with the lid. Prior to such removal, the primary latching assembly includes an interference lug having a compression section which engages the upwardly disposed surface of an engaging groove formed within the rim structure of the container. After removal of the primary latching assembly, a secondary latching arrangement is maintained which includes the upper skirt portion, a generally semi-cylindrically shaped rim interior portion having a bead conforming surface nestable in seating adjacency with the upwardly disposed container rim bead and a detent defining ridge formed integrally with the skirt upper portion interior surface at a location for snap-on engagement with the rim structure of the container.

24 Claims, 25 Drawing Figures

11
21
23
24
25
31
32
33
38
40
2A
3A
4A
18
34
36
42
44
16
12
14

21
23
24
25
27
31
32
33
34
36
38
40
48
50
58
62
64
66
70
78
82
84
86
90
92
94
96
16
18

MOLDED LID ASSEMBLY WITH PRIMARY AND SECONDARY LATCHING FEATURES

BACKGROUND

Industry generally concerned with the production of cylindrically shaped containers typically has categorized them in terms of ranges of capacity. For example, those containers having volumetric capacities of from about eight gallons to fifty gallons are referred to as "drums", while intermediate size containers having volumetric capacities between about three and seven gallons are referred to as "pails" and containers below the latter size, carrying contents weighing from about four ounces to two pounds, generally are referred to as "tubs".

The design of the containers themselves are somewhat similar throughout the industry, however, lid structures which are applied to the containers are seen to vary somewhat. Typically, drums are fashioned of a fiber or cardboard material in view of the weight of the substances they are called upon to carry. However, metals and plastics also are used in drum fabrication. Generally, these materials will range from about 50 to 500 pounds per drum. As a consequence, the drums, when filled, typically will be warehoused and moved by personnel employing hand carts or forklifts and the like and thus, from time to time, will be tipped over or dropped. Because of the usually encountered chemical nature of the contents of the drums, lid securement for them is important to avoid spillage. Generally, to enhance strength and lid attachment, the rims of the drums are reinforced with annular metal chimes formed having a rim bead and an inwardly extending region or groove just below the bead, the mounting of which effects a deforming securement to the drum wall and which is employed to aid in locking lids to the drums. The lids typically closing the drums are formed as stamped metal components which are secured over the rim-chime assemblies with metal locking rings to assure the lid-tight security of the drums under tipping or drop conditions. As a consequence, to open up a drum, the locking ring is released and removed, whereupon the lid itself is removed and the drum contents then are accessed. To subsequently close the drum after removing some of the contents, the lid is repositioned and the locking ring is remounted, then tightened for securement. This open-close process becomes tedious where the contents of the drum are regularly accessed. For instance, drums containing swimming pool chemicals are opened and closed on a somewhat regular basis. As a consequence of the effort required for this process, the drum lids typically are merely positioned loosely on the drum rims and the locking ring feature of closure is ignored. This failure to secure the kids with the locking rings leaves the drums in an unsealed condition and leads to degradation of the remaining drum contained contents, i.e. the outgassing of chlorine from swimming pool chemicals. In the latter regard, chlorine is exothermic and inadvertent wetting of such chemicals can generate hazards.

Pails typically are formed of plastic (for example, polyolefins) with container bodies of a frusto-conical shape. The lids used to close them generally are discoidal in their general shape and typically are similarly fashioned of a resilient plastic. Usually, these lids are secured in position by structures which require the use of a screwdriver or similar prying instrument to open them. Unfortunately, subsequent access to the pails requires a similar prying implementation to frustrate the user from properly sealing the pails after using only a portion of their contents.

To retain lids upon pails, a configuration generally is provided for the pails which includes an integrally molded rim structure formed without resort to the chime structure of drums. This rim structure includes an upwardly disposed rim bead, as well as an engaging region formed inwardly and below the bead. Lid designs then vary but are concerned with a sealing structure using the rim bead and, often, the engineering region.

The smaller tub structures are generally configured of a vacuum formed, thermoformed, or injection molded material and the lid considerations for them look to the provision of a "tamper evident" feature. In the latter regard, it is desirable for many products to provide an indication as to whether any unauthorized opening of the lids of the tub has occurred subsequent to their being filled, for example with edible products. For the most part, the tamper evident procedures have been designed for that feature alone and not with considerations of improving the seal security of the lid-container combination in the first instance.

Stacking considerations are finding importance in both container and lid designs. Two aspects for such stacking occur, one stemming from requirements for transporting the containers empty, inasmuch as they maybe transported separately and the second consideration concerns the warehousing of the filled containers with lids attached. Where lids are tranported, it is desirable that they be stackable in some form of nesting relationship to facilitate their movement in the factory environment both where they are produced and at such time as they are employed to close a filled container. Particularly in the case of drums, the heavy weights involved become considerations in terms of warehousing and the like. Where pails and tubs are concerned, stacking requirements for both warehousing and retail display are assuming higher levels of importance. In some applications, it is preferred to pre-attach lids to containers for the purpose of a stacked shipment of the entire assembly. It then becomes desirable to provide a dual or first and second level clause arrangement. For such application the secondary latch is receiced following filling of the container.

SUMMARY

The present invention is addressed to a lid for closure over conventional containers which advantageously may be formed with a molded plastic material such as a polyolefin. A primary latching feature is incorporated within the lid structure which includes an interference lug assembly having a compression section which functions to retain the lid in a highly secure locking fashion following the initial securement of the lid upon the container. This primary latching assembly remains intact until it is removed by grasping a tear ring located within a lower skirt portion of the lid and which cooperates with a parting groove to effect removal of the primary latch. Advantageously, such removal of the primary latching assembly may be accomplished readily without tools and that portion of the lid securement feature may be discarded. For utilization of the container on a day-to-day basis following the removal of the primary latching assembly, a secondary latching assembly is incorporated which remains intact and is readily disengaged and engaged from the rim structure of the container by hand and without tools. Thus, a lid structure is provided which promotes the day-to-day proper closure of the lid assembly by those accessing the contents of the associated container.

Because the primary latching assembly must be manually removed prior to accessing the contents of the container with which the lid is associated, a tamper evident feature is provided which is an important function of the lid latching structure itself. To facilitate the manufacture and transportation of the lid structures, a lid stacking feature is provided. Particularly where drum sized containers are employed with the lids, a drum stacking feature also is structured into the lid assemblies in a manner wherein the sidewalls of the drum containers are in mutual alignment when the drums are stacked during warehousing or the like. The drum associated lid structure further employs an annular undulatory region at the top portion of the lid which functions to accommodate for distortions in the rim structure of the containers which may be occasioned by tipping or dropping the drums. Thus, the resilient memory characteristics of the molded plastic lids are accommodated for to promote security of closure during the maneuvering of the loaded containers. A further feature of the lids as they are applied to drums involves the provision in the primary latching feature of a technique for containing the latch function even though an "after shock" of the contents of the drum is encountered when they are dropped.

Another feature of the invention is to provide a molded lid for removable closure over a container of a variety having a bottom and sidewall extending outwardly therefrom to a top portion which includes a rim structure having an upwardly disposed rim bead, an outwardly disposed side surface portion and an inwardly extending engaging region or groove formed inwardly of and below the rim bead and which has an upper contact surface. The lid includes a top portion formed of resilient plastic material which is extensible across the container top portion to an outer periphery which is located adjacent the rim structure of the container. A skirt assembly is integrally formed with the top portion and extends downwardly from the periphery to a lower edge which is locatable below the engaging region top surface of the container. A primary latching assembly is integrally formed with the skirt assembly of the lid and includes a plurality of discrete, lid lock pocket assemblies formed integrally with the skirt and defining a lock chamber intermediate the inwardly disposed side of the skirt assembly and the container sidewall. An interference lug is pivotally coupled with the skirt lower edge at a lid lock pocket assembly for pivotal movement about the lower edge into the lock chamber and into a securing orientation for deriving abuttable contact with the engaging groove upper contact surface to effect substantially rigid compressive restraint between the pivotal coupling and the skirt lower edge and the contact surface abuttable contact and which is resiliently deformable toward the inside surface of the skirt assembly when the lid skirt is being positioned over the rim structure. The skirt assembly includes a parting groove extending thereabout to define upper and lower skirt portions and includes a hand graspable device such as a tear ring which is coupled with the skirt lower portion for effecting the manual removal of the lower skirt portion from along the parting groove. Removal of the lower skirt portion includes removal of the primary locking assembly interference lugs. The lid assembly additionally includes a secondary latching assembly including a generally semi-cylindrically shaped lid rim disposed at the lid top portion outer periphery and having a bead conforming interior surface nestable in seating adjacency with the upwardly disposed container rim bead. Additionally, the upper skirt portion is configured having an internal dimension selected as less than the corresponding outside dimension of the container rim structure outwardly disposed side surface portion to effect a press fit therebetween. As an additional component of the secondary latching assembly, a detent defining ridge may be formed integrally with the skirt upper portion interior surface at a location for snap-on engagement with the rim structure engaging region.

Other objects and features of the invention will, in part, be obvious and will, in part, appear hereinafter.

The invention, accordingly, comprises the apparatus possessing the construction, combination of elements, and arrangement of parts which are exemplified in the following detailed disclosure. For a fuller understanding of the nature and objects of the invention, reference should be had to the following detailed description taken in connection with the accompanying drawings.

DETAILED DESCRIPTION

In the disclosure to follow, the lid structure of the invention as it is applied to drum type containers initially is described. Following this description, the application of the invention to pails is discussed, the latter descriptions also applying to applications to tub size containers. The description then looks to alternate embodiments of the above.

Figure 1:
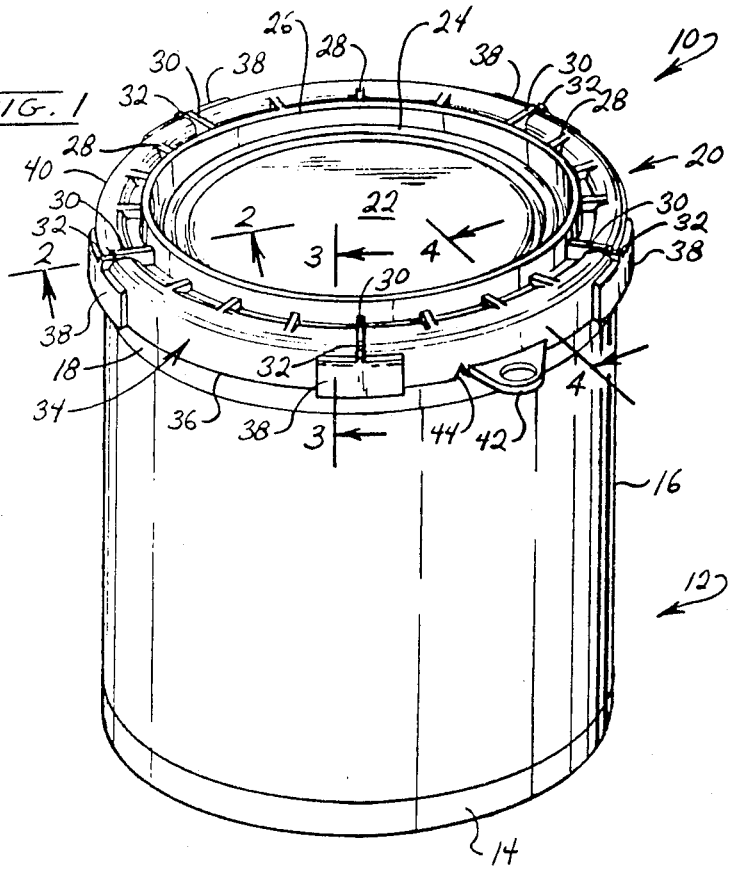
FIG. 1 is a perspective view of a drum type container and lid assembly according to the invention.
Figure 8:
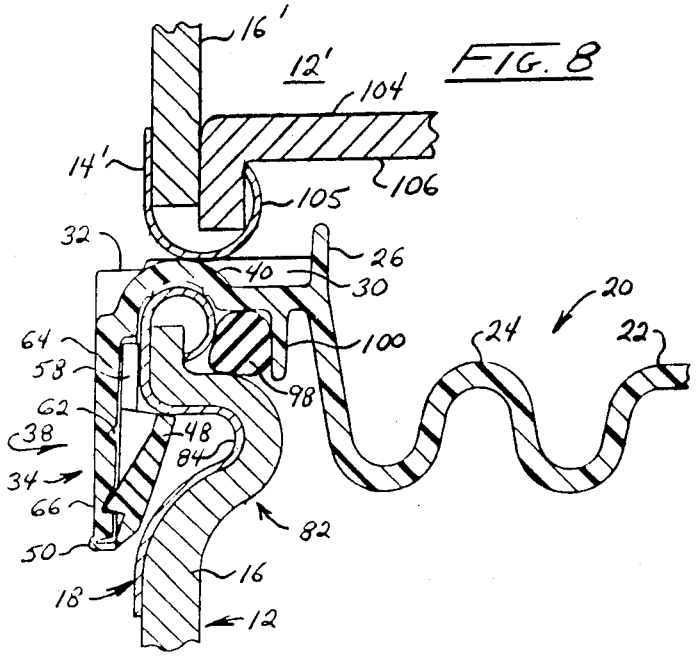
FIG. 8 is a partial sectional view of a lid and container structure shown in FIG. 1 and revealing a stacking feature incorporated therein.

Looking to FIG. 1, a drum having a lid structured in acordance with the teachings of the invention is revealed generally at 10 in pictorial fashion. The combination includes a cylindrically shaped drum shown generally at 12 having a bottom portion 14 from which extends a cylindrically shaped sidewall 16 which, in turn, terminates at the top of the container with a rim structure including a metal chime 18, the lowermost portion of which is revealed in the figure. Bottom portion 14 is a formed metal component attached to sidewall 16 as shown in FIG. 8. The drum 12 is shown being closed by a lid shown generally at 20 which may be formed, for example, as an integrally molded polyolefin form of plastic. The lid 20 is illustrated in the orientation it assumes after it initially has been mounted upon the drum 12 in securing fashion. In general, lid 20 includes a top portion 22 which, looking from the center of the lid radially outwardly, is seen to be somewhat flat in the center and extends to a sequence of accordian-like undulations 24 which extend to an upstanding centering rib 26. For the instant embodiment, extending radially outwardly from the centering rib 26 are a plurality of stiffeners certain of which are identified at 28 which serve additionally as container stacking ribs. Note that the ribs 28 additionally may be considered to be generally perpendicularly oriented with the outer periphery of the lid 20. Certain of the stiffening devices as at 30 serve the additional function of providing lid stacking notches certain of which are revealed at 32 which are located at the outermost portion of the periphery of lid 20. Seen extending downwardly from that outer periphery is a skirt assembly represented generally at 34 which extends to a lower edge thereof 36. Formed integraly with the skirt 34 and positioned beneath the lid stacking ribs or stiffeners 30 are discrete lid lock pocket assemblies 38 which are integrally molded with the skirt assembly 34 and lid 20. The pocket assemblies 38 will be seen to comprise a portion of a primary latching assembly of the lid 20. These pocket assemblies 38 are seen to extend between the lower edge 36 of the skirt assembly 34 and the rim of the lid at 40. Extending outwardly from the lower portion of the skirt assembly 34 is a hand graspable tear ring 42 which is positioned adjacent a starting notch 44 and includes a hole or aperture such that the device may be grasped and the lower portion of the skirt assembly may be pulled and torn away during the initial opening process in a manner serving to remove the primary latching assembly of the lid 20. Following such removal, a secondary latching assembly permitting fascile resealing of the lid remains intact.

Figure 5:
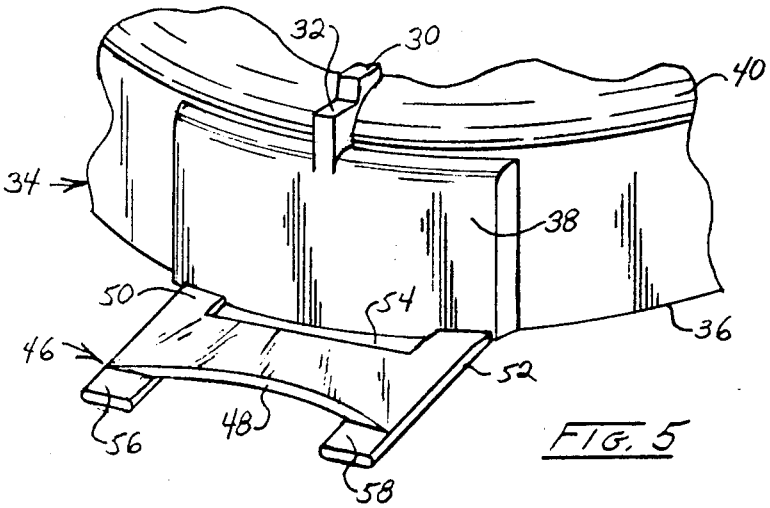
FIG. 5 is a fragmentary perspective view of a portion of the lid structure illustrated in FIG. 1 and showing the interference lug structure thereof prior to placement upon a cotainer.
Figure 6:
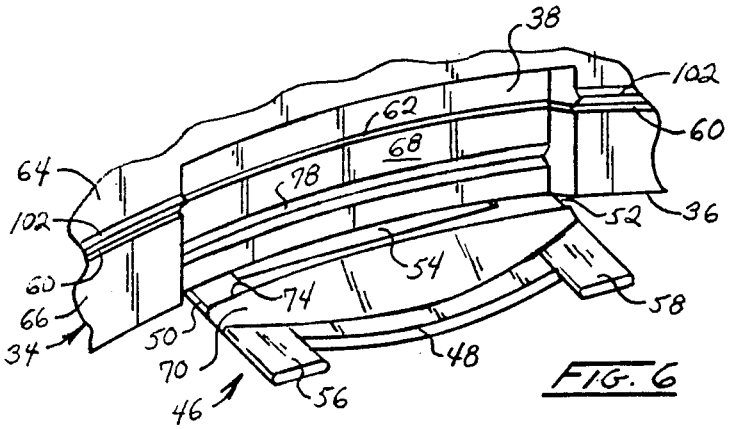
FIG. 6 is a fragmentary perspective view of the lid structure illustrated in FIG. 1 showing the interference lug components thereof having been partially folded prior to placement on a container.

Looking to FIGS. 5 and 6, the principal components of the primary latching assembly which are integrally molded within lid 20 are revealed in perspective fashion. FIG. 5 shows the outwardly disposed surface configuration of the lid lock pocket assemblies 38, as well as the configuration of an interference lug represented generally at 46 and configured for the drum closure applications of lid 20. Representing a component of the primary latching assembly, the lug 46 is shown in FIG. 5 in the orientation which it assumes as the lid 20 is removed from its mold during manufacture. Generally, this orientation will be maintained until such time as the lid 20 is positioned upon a drum 12. In some applications the lids will be positioned upon empty drums with this orientation of the lug 46 remaining. The drum-lid assembly then is shipped in that orientation to a location for drum filling and finally closure. Lug 46 is shown to be configured when so manufactured to have a compression section 48 of arcuate shape which extends between two hinged attachment portions 50 and 52. The latter hinge portions 50 and 52 incorporate a fold region not seen in the instant figure attached to lower edge 36 of the skirt assembly 34. As initially molded, the compression section 48 is arched upwardly and the hinge attachments 50 and 52 are seen to be positioned on either side of an opening 54 located between the hinge portions 50 and 52. The opening 54 is located as shown to permit the inward folding of the interference lug 46 at such time as the lid 20 is fastented to the drum 12. For the drum closure embodiment shown in the figure, the interference lug 46 additionally includes two retainer tabs 56 and 58 which extend outwardly from the compression section 48.

Looking to FIG. 6, a pictorial representation of the integerence lug 46 as it is pivoted about hinge portions 50 and 52 inwardly in the course of lid 20 placement upon drum 12 is shown. The figure reveals that the skirt assembly 34 includes a parting groove 60 which is continuous about the skirt and is seen to extend through each of the lid lock pocket assemblies 38 as shown at 62. Groove 60 divides the skirt assembly 34 into an upper skirt portion 64 and a lower skirt portion 66. Thus, the hinged connection of the interference lug 46 at 50 and 52 is provided with the lower skirt portion 66 and permits the pivoting of the lug inwardly into a cavity 68 located at the inwardly disposed surface of skirt assembly 34. Lug 46 additionally is configured having an outwardly extending detent component 70 which is of a generally wedge shape and include an abuttable contact surface 74 which will move into abutting contact with a corresponding receiving notch 78 formed within the inner surface of skirt assembly 34 lower portion 66. With the arrangement shown, when the interference lug 46 is pivoted fully inwardly into the cavity 68 of the pocket 38, contact surface 74 will come into abuttable contact with the horizontal lower surfaces of notch 78. This association of components will be seen to effect an absorption of transiently imposed compressive loadings or shocks which will be experienced should the assembly 10 be dropped in a manner wherein the lid 20 or portions thereof make contact with the floor or ground and a load shifitng phenomenon (after shock) of the contents of the assembly 10 is experienced.

Figure 2:
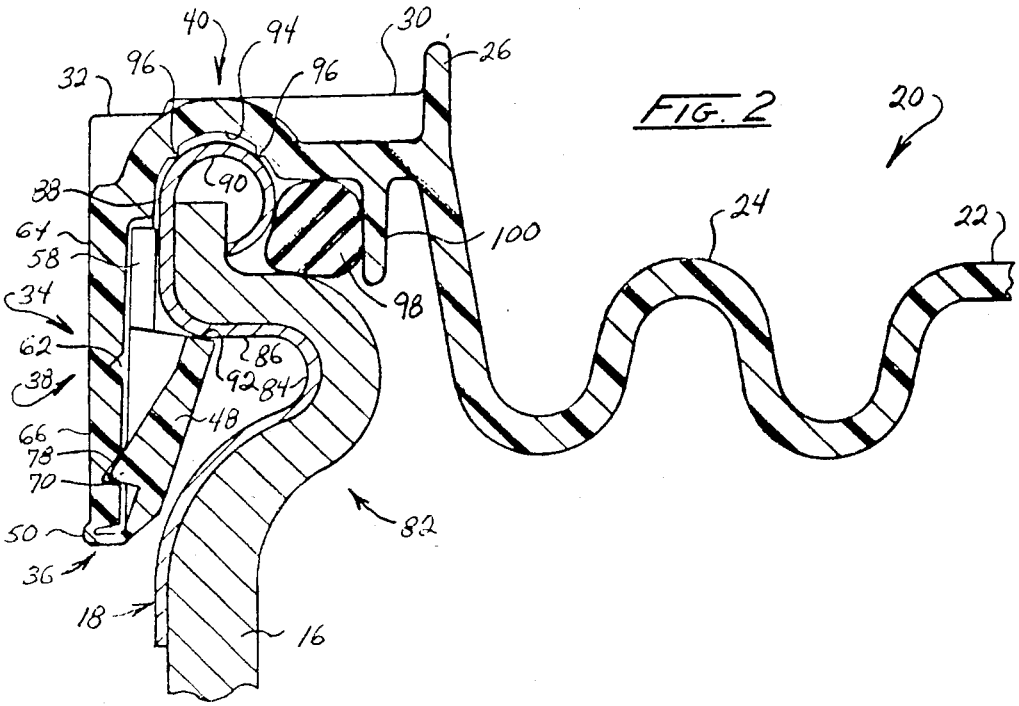
FIG. 2 is a partial sectional view taken through the plane 2—2 shown in FIG. 1.

Turning to FIG. 2, a partial cross-sectional view of the lid 20 is shown including the primary latching assembly component as above discussed as they are associated with the rim structure of drum 16 shown generally at 82. The rim structure 82 includes the earlier described metal chime 18 which is configured in conjunction with the drum sidewall 16 to provide an inwardly extending engaging region or groove 84 having an upper contact surface 86. Chime 18 and drum sidewall 16 further are configured to define a side surface portion 88 and the chime extends upwardly therefrom in encircling fashion to define an upwardly disposed rim bead 90. The figure shows the orientation of the lid 20 as it is positioned upon the drum 12 is securing orientation. In this regard, the primary latching assembly is seen to have positioned compression section 48 of interference lug 46 in an orientation where its upward contact surface 92 is in abuttable contact with the upper contact surface 86 of the chime groove or region 84. The lower portion of the interference lug 46 is secured, inter alia, by hinged attachments 50 and 52, the former being shown in the figure. Note that these hinged attachments are configured as narrow fold regions, i.e. integrally formed portions of the entire assembly of lesser thickness. Tab components 56 and 58 nest between the interior disposed surface of upper skirt portion 64 and the side surface 88 of the rim structure 82 of drum 12. The figure reveals that compression section 48 prohibits upward movement of the lid 20 and, in so doing, is compressively engaged between surface 86 and the hinge connection 50. This orientation is maintained under impact phenomena and the like by virtue of the above-described securement of the tabs 56 and 58, tab 58 being shown in the drawing.

Portions of the secondary latching assembly also are shown in FIG. 2, for example, the generally semi-cylindrically shaped lid rim 40 disposed at the outer periphery of the lid top portion 22 is configured having a bead conforming interior surface 94 which is nestable in seating adjacency with the rim structure 82 bead 90. Pressure or sealing lines 96 additionally are integrally molded within the interior surface 94 to assure sealing integrity notwithstanding variations which may be encountered in the structure of the bead 90. The surface 94 is shown in the drawing in spaced relationship from the corresponding outer surface of bead 90 in the interest of clarity. In practice, the juncture between these components is one of intimate adjacency, the line 96 being compresses and, additionally, the upper skirt portion 64 being configured in a press fit fashion with the surface 88 of structure 82. Note that notch 78 is engaged by detent component 70, the abuttable contact surface being positioned for restraining transient loading. Sealing integrity between the lid 20 and drum 12 further is enhanced by the provision of a ring gasket which is positioned on the inward surface of the lid 20 and is supported by an annular retainer ridge 100 to effect a sealing abuttment against the inwardly disposed portion of the rim structure 82. In the latter regard, the gasket 98 is seen to be abuttable engagement with the inwardly curved portion of the sidewall 16 formed above upper contact surface 86 of chime 18 as well as in abuttment with the inwardly disposed portion of bead 90.

Figure 3:
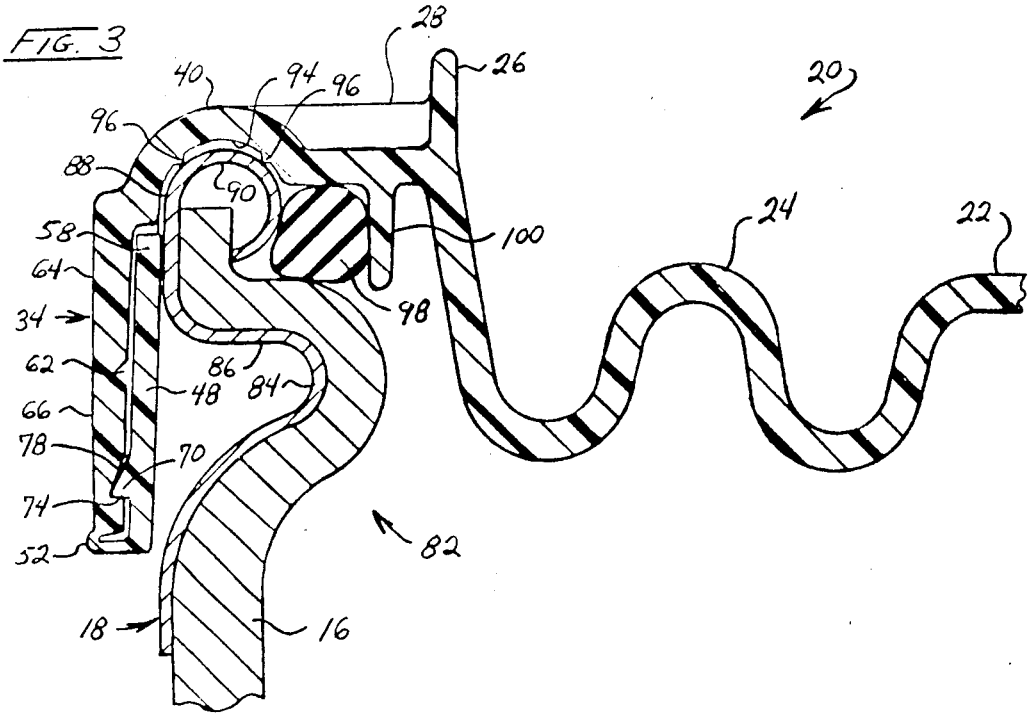
FIG. 3 is a partial sectional view taken through the plane 3—3 shown in FIG. 1.

Looking to FIG. 3, a cross-sectional view of the latching arrangement is revealed which represents a cross-section offset with respect to that of FIG. 2. In the figure, the abuttable contact surface 74 of detent component 70 is seen to be engaged within receiving notch 78 and the tab 58 as well as the side, non-arcuately formed portion of compression section 48 is revealed. It may be observed that the detent component 70 and receiving notch 78 association serves to provide additional support for the compression section 48. As noted above, this arrangement is provided inasmuch as the pivoting or hinge portion represented at the fold region at 52 necessarily is weaker to achieve a pivoting action. Under conditions where the drum 12 is carrying a load and the lid 20 is completely attached to the drum, the load will shift subsequent to initial impact to transiently impose a relatively high impact force against the underside of lid 20. This impact force is transmitted from the lid through the skirt assembly 34 and into the compression section 48 of interfering lug 46. With the arrangement, a substantial amount of the thus transmitted force is asserted through the detent component 70-receiving notch 78 interaction.

FIGS. 2, 3, 5 and 6 reveal that the lid structure 20 initially is securably positioned upon the drum 12 by folding the interference lug 46 inwardly and pushing the lid onto the drum 12 rim structure 82. As this procedure ensues, the arcuate compression section 48 of the lug 46 is deformed inwardly as it passes over the outwardly disposed side surface portion 88 of the rim structure 82. As the resiliently deformable arcuately configured compression section 48 passes side surface portion 88 of the rim structure 82, it is pushed inwardly into the cavity 68 pocket 38 until such time as the upper surface thereof 92 (FIG. 2) falls just below the upper contact surface 86 of groove or region 84. It then resiliently snaps back into the orientation shown in FIG. 2. Additionally, as this movement occurs, the detent component 70 moves into engagement with the corresponding receiving notch 78 in the lower skirt portion 66 of the skirt assembly 34. As this position is reached, the secondary latching features also are engaged with the rim structure 82 in a sealing relationship.

Figure 4:
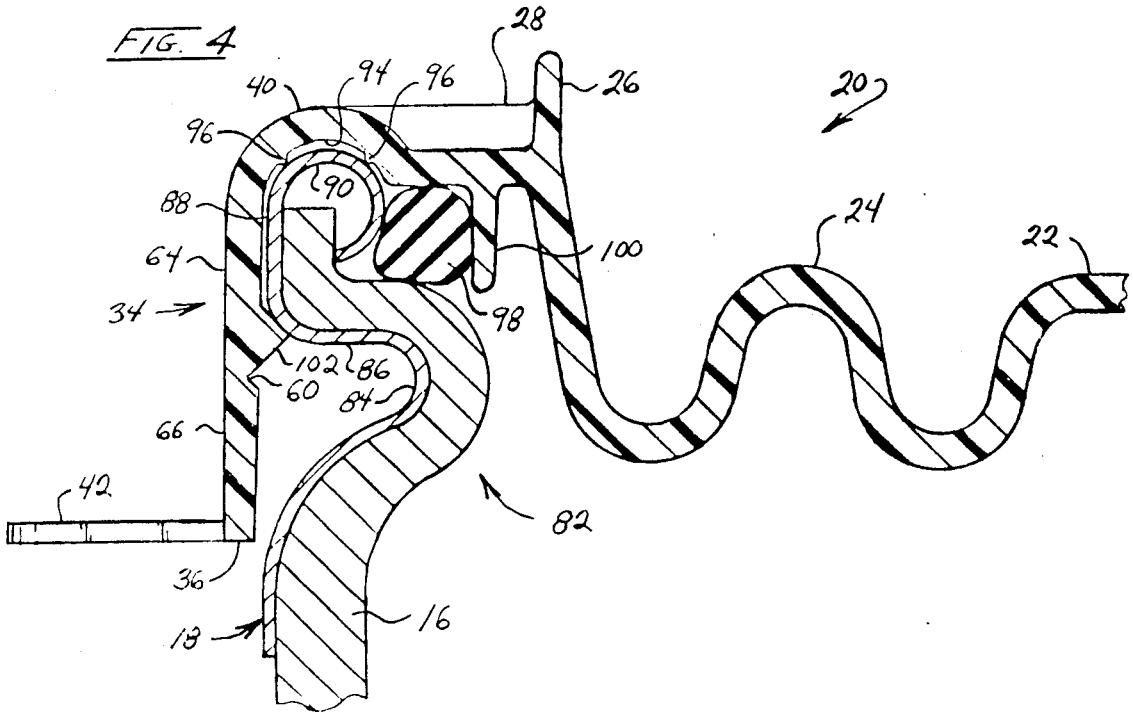
FIG. 4 is a partial sectional view of the structure shown in FIG. 1 taken through the plane 4—4 indicated therein.

Looking to FIG. 4, a cross-section is provided which reveals the structure of the secondary latching assembly. The latter latching arrangement is comprised of three elements, the generally semi-cylindrically shaped lid rim 40 having an interior surface 94 which is nestable in seating adjacency with the chime rim bead 90 of the rim structure 82. Additionally, the skirt assembly 34, particularly the upper portion thereof 64 is dimensioned having an internal diameter which is slightly less than the corresponding outside dimension of the side surface portion 88 of the rim structure 82. A spacing between these components is shown in the figure, however this spacing is only for the purpose of drawing clarity. In actual practice, a close sealing association is provided between the subject surfaces. Additionally, the noted sealing lines 96 are provided in conjunction with the rim bead. Finally, the secondary latching includes a detent defining ridge 102 which is positioned just above the parting groove 60. As is apparent, the secondary latching assembly provides a sealed connection of the lid 20 with the drum 12 upon the initial closure of the lid thereupon.

To open the drum 12-lid 20 assembly following the initial closure of the lid 20 upon the drum 12, the tear ring 42 is grasped and the primary latching assembly is removed by tearing the lower skirt portion 66 off the skirt portion 34 along parting groove 60. This removes all of the primary latching components including the interference lugs 46. Looking additionally to FIG. 7, the starting notch to facilitate this tearing action is revealed at 44 and a lead groove is shown at 103 extending from the starting notch 44 to the parting groove 60. Thus upon grasping the tear ring 42, a parting will commence at notch 44 and be lead to the parting groove 60 along lead groove 103 to facilitate initial removal procedures. As is apparent, upon removal of the primary latching assembly, the secondary latching assembly remains intact. However, the lid can be manually removed with respect to the secondary latching assembly and, importantly, the lid 20 can be repositioned upon the drum 12 and the secondary latching assembly is readily re-engaged without undue effort.

For the most part, the lids which are supplied for closure of drums are fabricated as metal stampings. Thus, when the filled drums are inadvertently dropped or fall over, the metal chime-rim structures 82 tend to deform and remaining deformed. Conventional metal lids, having no resilient memory, will also deform with the rim structure usually to maintain the lid seal. For the instant invention, however, while considerable advantage is achieved through fabrication utilizing plastics, those materials do have a resilient memory. To accommodate for this characteristic, the undulations 24 are provided which will deform with the rim structures 82 to maintain the integrity of the lid seal under rim deformation conditions.

Looking to FIG. 8, the stacking feature for the drum-lid combination is revealed. In the figure, an upwardly disposed drum represented in fragmentary form at 12' is shown having a fibre bottom portion 104. The metal bottom portion 14' is shown, as is typical with drums, having a chime configuration including circular inner side surface 105 such that the drum 12' additionally has a circular shaped inner cavity as at 106. The lid 20 thus, when positioned upon a drum 12, provides for the centering of the top drum 12' employing the centering ring 26 as it abutts against the side 105 of the foot or chime 14' of the upper drum. The chime 14' is seen resting on the top surface of one stiffener or stacking support 30. It may be observed that with the structuring shown, the sidewall 16' of drum 12' is aligned with the corresponding sidewall 16 of the lower drum 12. Thus, no undesirable turning moment is imposed upon the lid which is located intermediate the two stacked drums 12 and 12'.

Figure 9:
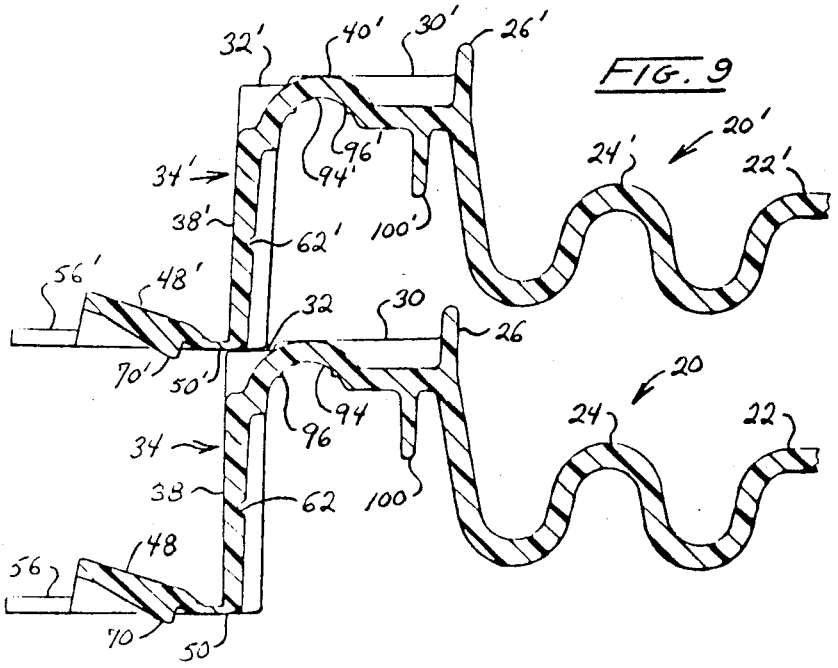
FIG. 9 is a partial sectional view of portions of the lid structure of FIG. 1 showing a lid stacking feature of the assemblage.

Looking to FIG. 9, the lid stacking feature of the instant design is revealed. In the figure, an upper lid represented in primed fashion is shown positioned upon a upper lid 20'. Stacking is achieved by nesting the bottom edge 50' of the skirt 34' of an upper lid upon the lid stacking notch 32 of the five stiffeners 30 of the lid 20. It further may be noted that the outwardly extending molded configuration of the interference lug 46 facilitates this lid stacking feature. Once so stacked, the lids are readily moved to any next given position in their manufacture.

Under conditions where the drum 12 will be subjected to somewhat severe impacts, for example creating corresponding severe deformations, then a greater degree of flexibility is required for the lid structure 20. A variation of the lid structure 20 is revealed in conjunction with FIGS. 1A–4A and 8A–9A. In the interest of clarity, where identifying numeration is unchanged with respect to the lid structure 20 heretofore described, that numeration is retained and the discourse concerning those components so identified remains appropriate.

Figure 1A:
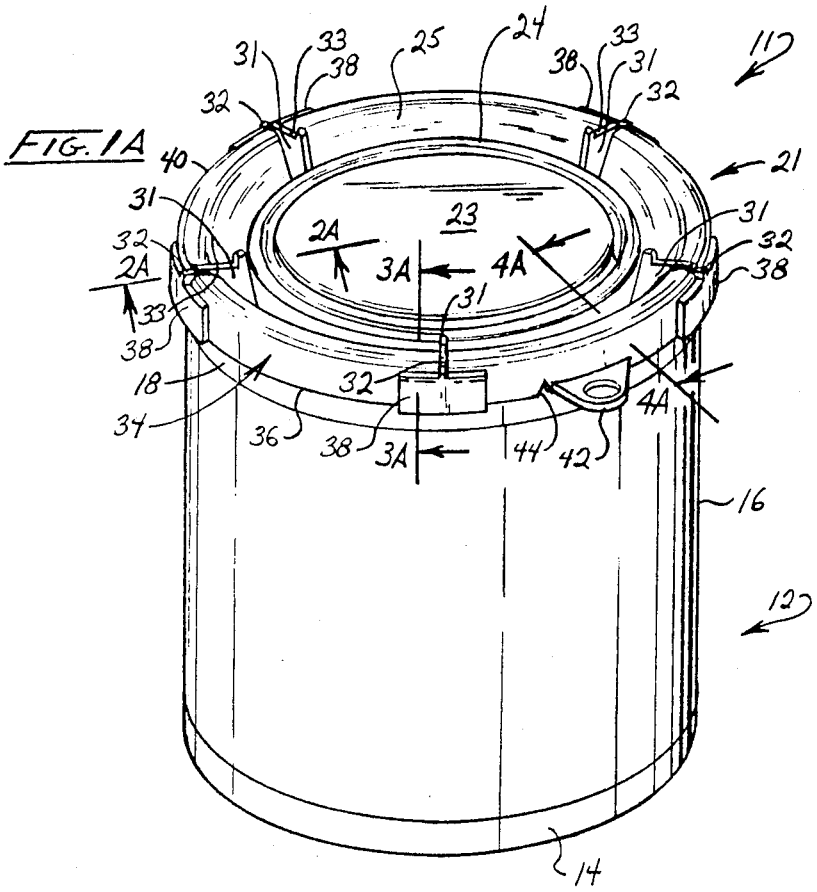
FIG. 1A is a perspective view of a drum type container and lid assembly similar to FIG. 1 but configured for more severe drum deformation conditions.
Figure 2A:
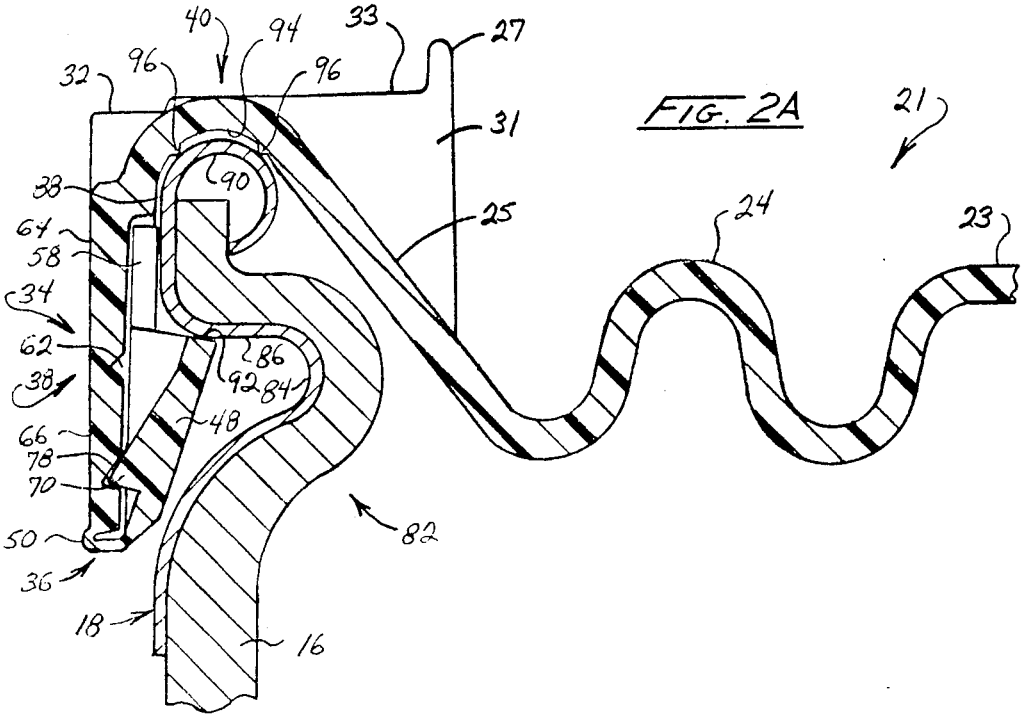
FIG. 2A is a partial sectional view taken through the plane 2A—2A shown in FIG. 1A.

Looking to FIG. 1A, the drum-lid assemlage now as identified generally at 11 as including the earlier-described drum portion 12 with sidewall 16 and a lid assembly now shown in general at 21. Referring additionally to FIG. 2A, the lid 21 is shown to include a top portion now represented at 23 which, looking from the center of the lid radially outwardly, is seen to be somewhat flat in the center and extends to the earlier-discussed sequence of accordian-like undulations 24 which now extend to an upwardly and outwardly sloping canted wall 25. Wall 25, in turn, extends to the earlier-described rim lid structure 40 which extends, in turn, to provide a seal over the bead 90 of the drum 12 rim structure 82. Spaced about this canted wall 25 are five integrally formed vertical stacking supports 31, each of which extends to a stacking support surface 33 which extends inwardly to a centerin lug 27. The latter centering lug 27 functions to align the next adjacently stacked drum 12 in appropriate stacking relationship.

Figure 3A:
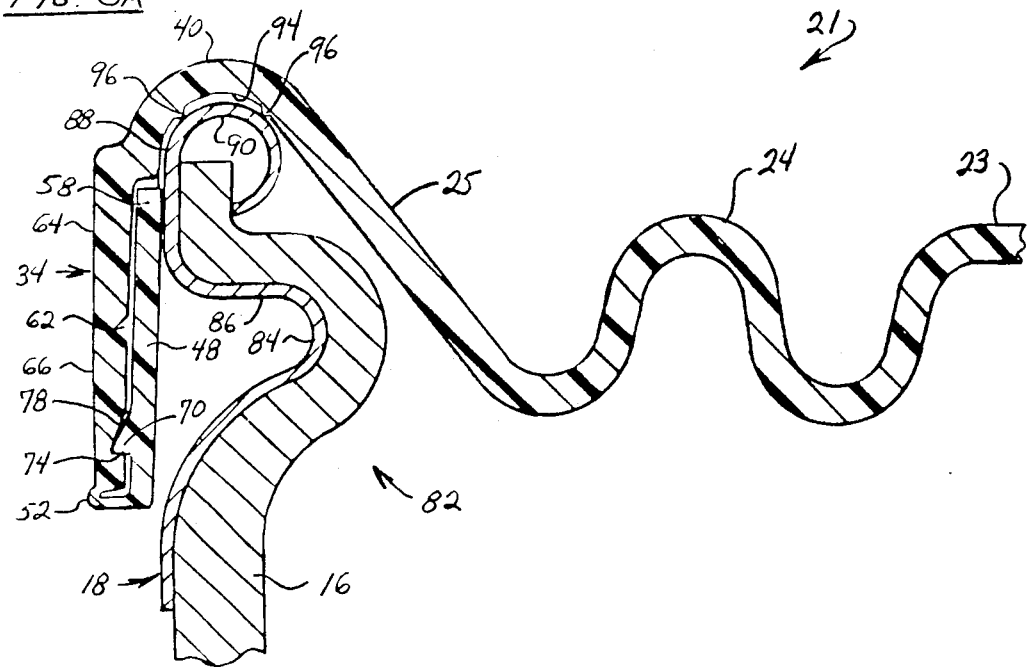
FIG. 3A is a partial sectional view taken through the plane 3A—3A shown in FIG. 1A.
Figure 4A:
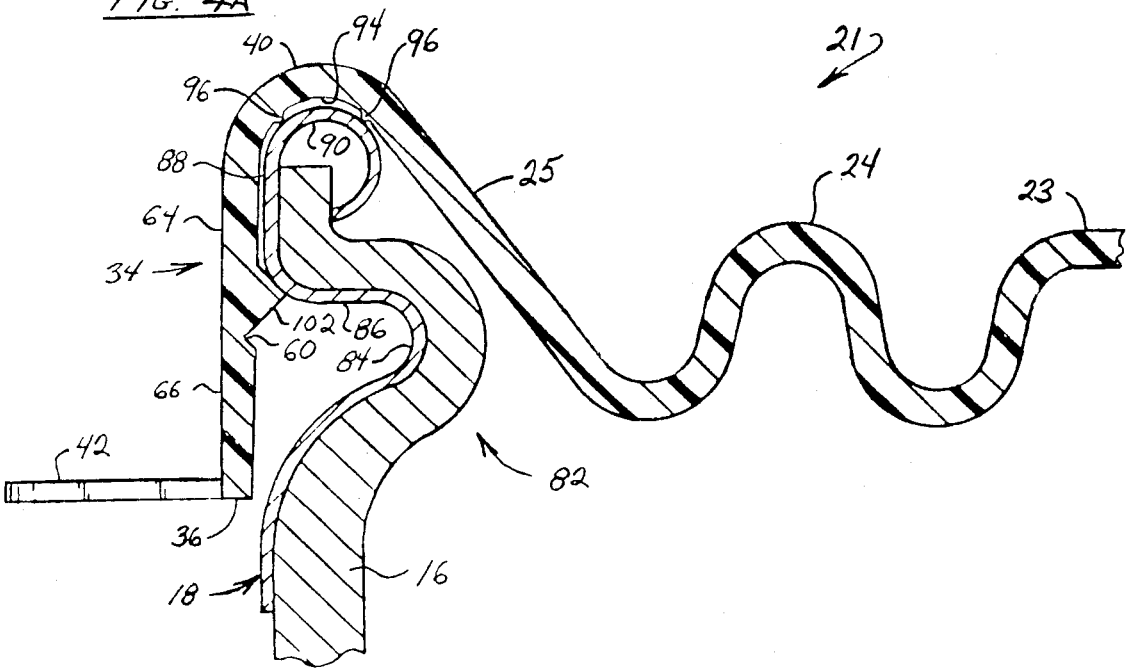
FIG. 4A is a partial sectional view of the structure shown in FIG. 1A taken through the plane 4A—4A indicated therein.
Figure 8A:
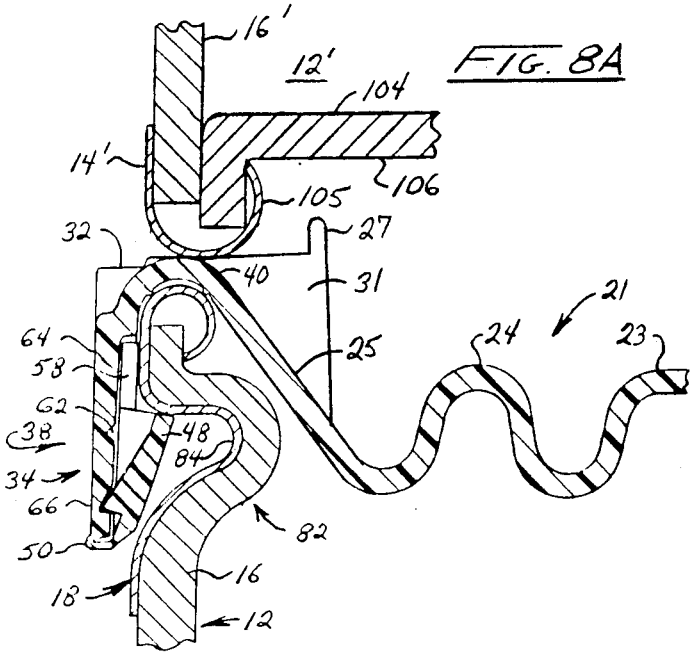
FIG. 8A is partial sectional view of a lid and container structure shown in FIG. 1A and revealing a stacking feature incorporated therein.
Figure 9A:
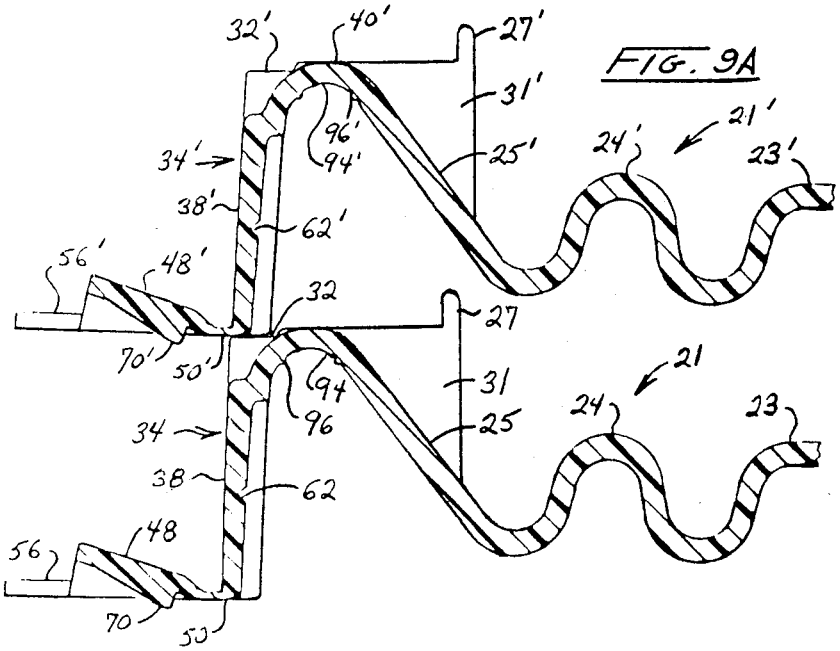
FIG. 9A is a partial sectional view of portions of the lid structure of FIG. 1A showing a lid stacking feature of the assemblage.

With the structure 21 so depicted, it may be observed that the stiffening developed with components 28, 30, and centering rim 26 have been removed. Additionally, with the instant embodiment the earlier-described gasket 98 and associated structuring is deleted. However, as represented in FIGS. 3A and 4A, the primary and secondary latching techniques remain substantially the same for the instant embodiment. Additionally, as shown in FIGS. 8A and 9A, the stacking technique remains essentially as before. In particular, for lid stacking and the like, the lid stacking notches 32 are retained for the instant embodiment.

Figure 10:
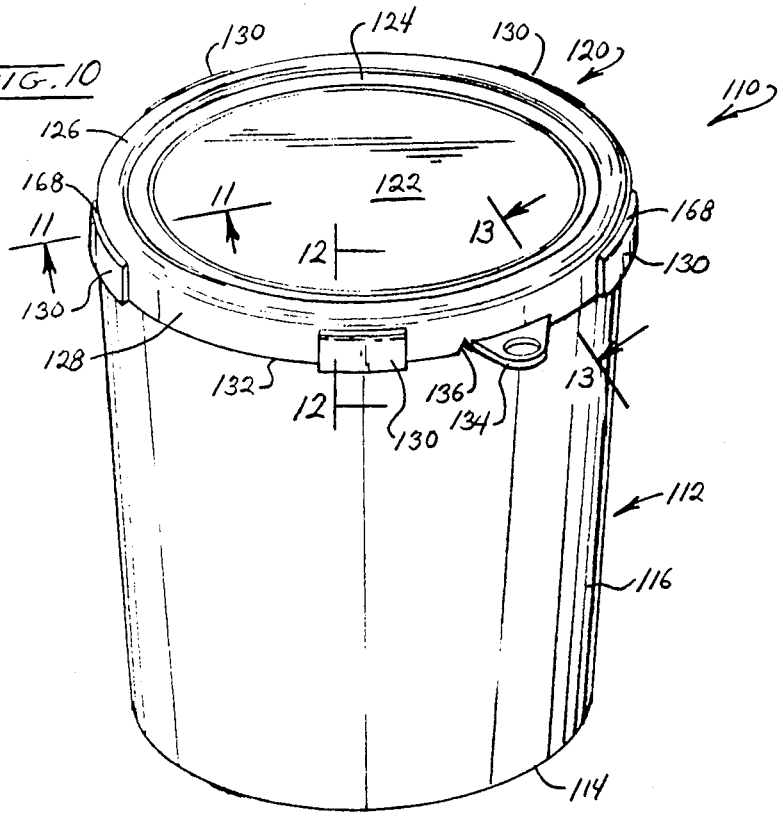
FIG. 10 is a perspective view of a lid-container assemblage having a lid embodiment suited for pails and structured according to the invention.

Referring to FIG. 10, a combination of the lid features of the invention with a pail structure is revealed generally at 110. Assemblage 110 includes a frusto-conical molded plastic container 112 having the above-noted capacity range of about 3 to 7 gallons. The pail 112 includes a bottom foot or ridge portion 114 from which extend sidewalls 116 which terminate in a rim structure 118 revealed in FIGS. 11 and 14. Over this rim structure there is positioned a lid according to the invention shown in general at 120. Thus, lid top portion 122 of lid 120 incorporates an annular stacking trough 124 adjacent its annular rim 126. As before, the lid rim structure 126 is at the outer periphery of the top portion 122 and extends to a skirt assembly shown generally at 128. As in the earlier embodiment, the skirt assembly 128 is formed having a plurality of discrete lid lock pocket assemblies 130 symmetrically spaced therein and extending from the rim 126 to the skirt 128 lower edge 132. Also similar to the earlier embodiment, the lid 120 incorporates a manually graspable tear ring 134 which is positioned adjacent a starting notch 136.

Returning momentarily to FIGS. 5 and 6, the embodiment of FIGS. 10–15 incorporates an interference lug feature which is substantially identical to that shown at 46 in conjunction with the drum embodiment. The singular difference between these components resides in the absence of retainer tabs 56 and 58 which are not required for the smaller containers involved. However, the hinged connections as at 50 and 52 along with the opening 54 therebetween are retained with the instant embodiment as well as the centrally disposed arcuately shaped compression section described earlier at 48. Additionally, the detent component 70 remain in the instant embodiment along with notches corresponding with the receiving notche 78 earlier described in connection with FIGS. 5 and 6.

Figure 11:
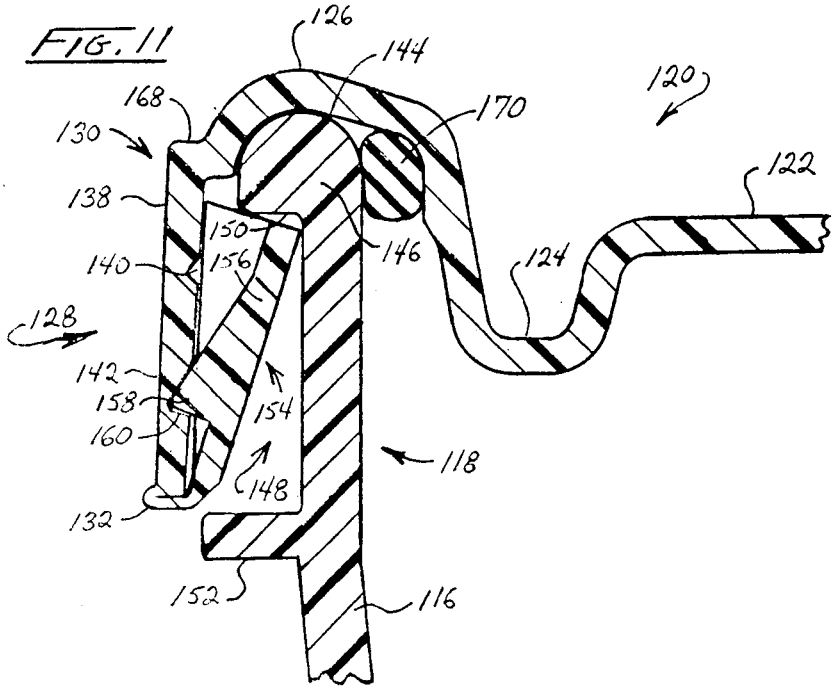
FIG. 11 is a partial sectional view of the container and lid assemblage shown in FIG. 10 taken through the plane 11—11 shown in the latter figure.

Looking to FIG. 11, the skirt assembly 128 is again seen to be formed of an upper skirt portion 138 which termiantes at an interiorly disposed parting groove 140 and a lower skirt portion is formed below the latter groove. The rim 126 of lid 120 is shown having a bead conforming interior surface 144 which is nested in seating adjacency with the upwardly disposed rim bead 146 of the container rim structure 118. Beneath the lid rim bead 146 there is formed an inwardly extending engaging region 148 having an upper contact surface 150. A rib 152 is shown extending outwardly from sidewall 116 to define the lower portion of the engaging region 148. In fashion similar to the drum embodiment of the invention, the lower edge 132 of the skirt assembly 128 is extended to provide hinge or narrow fold region at each lid lock pocket assembly 130. These fold regions are configured in the same manner as those providing the hinges 50 and 52 of the drum embodiment. The hinges of fold regions support an interference lug represented generally at 154 which includes a centrally disposed arcuate compression section 156 corresponding to that described earlier at 48.

Figure 12:
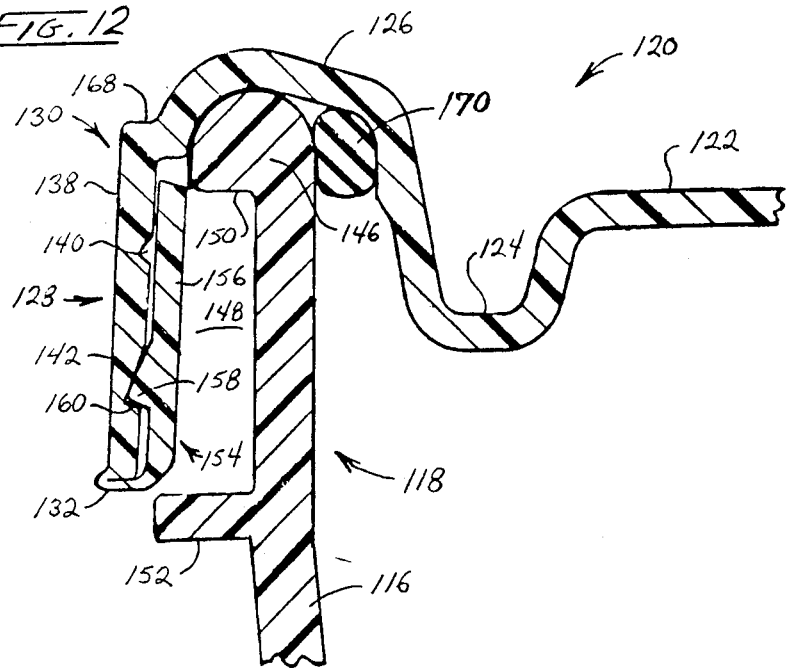
FIG. 12 is a partial sectional view of the lid and container structure shown in FIG. 10 and taken through the plane 12—12 shown in the latter figure.

FIG. 12 reveals the outer flap portions of the interference lug 154 as well as one of the two outwardly extending detent components 158 corresponding to those shown in FIG. 6 and the receiving notch 100 associated therewith within the interiorly disposed surface of skirt assembly lower portion 142. A positive lock is thus provided by the assembly which retains the lid 122 in place over the container 112 until such time as the tear ring 134 is employed to remove the primary latching assembly. This, of course, additionally provides a tamper evident feature which is part of the primary locking assembly as opposed to being a separate structure within the lid. A gasket is provided with the lid as represented at 170.

Figure 7:
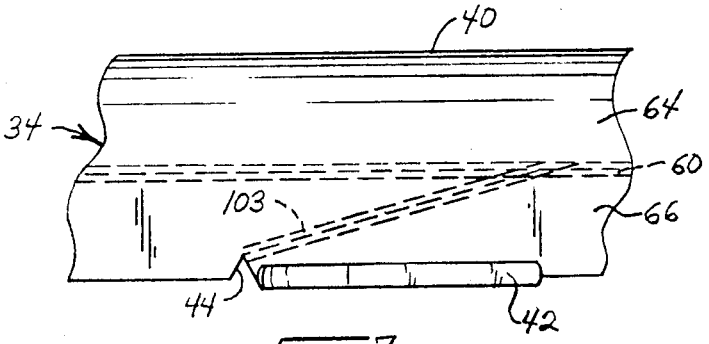
FIG. 7 is a partial fragmentary view of the lid structure shown in FIG. 1 and revealing a lid removal feature thereof.
Figure 13:
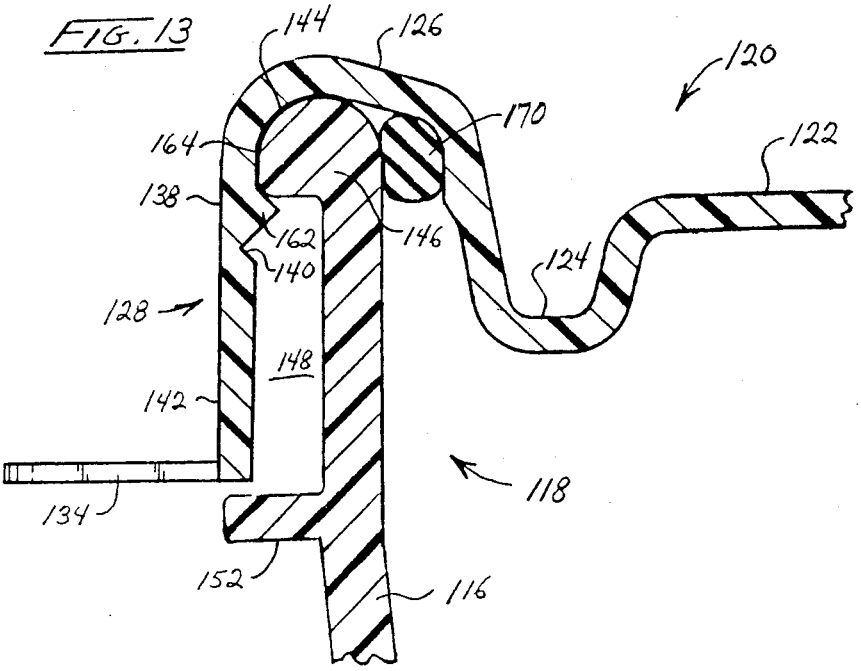
FIG. 13 is a partial sectional view of the lid and container assemblage shown in FIG. 10 and taken through the plane 13—13 shown in the later figure.

Looking to FIG. 13, the secondary latching assembly is revealed to encompass the components above the parting groove 140. This secondary latching assembly permits repeated removal and repositioning of the lid 122 upon the container 112 once the tear ring 134 has been grasped and the lower skirt assembly 142 has been removed. A lead groove similar to that described at 103 in FIG. 7 provides for appropriate communication from the notch 136 (FIG. 10) and the parting groove 140 as in the drum embodiment (FIG. 7). FIG. 13 shows that the secondary latching components include a bead conforming interior surface 144 nesting against the outer surface of bead 146; a detent defining ridge 162 which extends entirely around the inner surface of skirt upper-portion 138; and the close fit between side surface portion 164 of bead 146 and the interior surface of the upper skirt portion 138. As before, the diameter of this interior surface is made slightly smaller than the external diameter defined by the surface 164 to assure an appropriate press fit. As in the case of the earlier illustrations, a slight gap is shown between the lid rim components and the corresponding components of the container 118 in the interest of drawing clarity. However, it should be understood that a very close press fit is intended to be provided.

Figure 14:
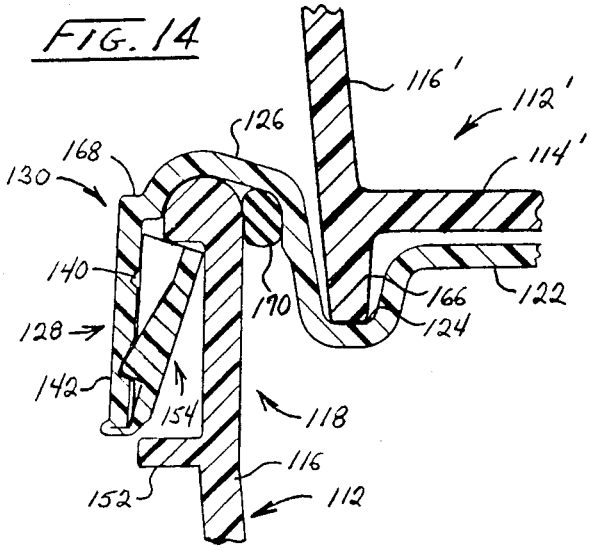
FIG. 14 is a partial sectional view of the lid and container assemblage of FIG. 10 showing a container stacking feature thereof.
Figure 15:
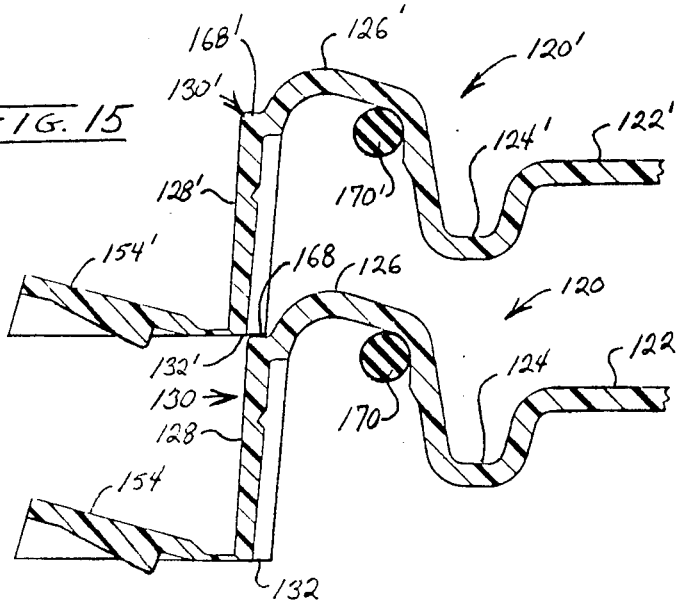
FIG. 15 is a partial sectional view of lid structures according to the embodiment of FIG. 10 showing a lid stacking feature thereof.

Looking to FIG. 14, the stacking arrangement for this embodiment is revealed. In this embodiment, there is no need for the alignment of side surfaces. The frustoconical shape of the pail type container 112 generally terminates in a lower extending annular foot portion 166 shown in the drawing in an upwardly disposed pail fragmentary drawing represented in primed numeration to include a sidewall 116′ and a bottom portion 114′. Note that the annular foot 166 nests within the trough 124 of the lid of a next lower pail to provide for stacking.

The pail embodiment of the invention as described in conjunction with FIGS. 10 through 14 also provides for a lid stacking feature. Looking to FIG. 15, a section of a lid according to the instant embodiment is shown generally at 120 with an identical lid shown in primed fashion positioned therebove in stacking relationship. The lid lock pocket assembly 130 of the lid is shown to protrude outwardly to provide a stacking ledge 168 shown in FIGS. 10–12, 14 and 15. It may be observed in FIG. 15 that the interference lugs 154 are molded such that they extend outwardly from the discoid periphery of the lids 120, being supported therefrom by their fold regions or hinged connections. Thus, the bottom portion 132′ of the lid 120′ adjacent the lid lock pockets 130′ are stacked upon the upstanding ledge 168 of a given previous lid in the stacking process.

Figure 16:
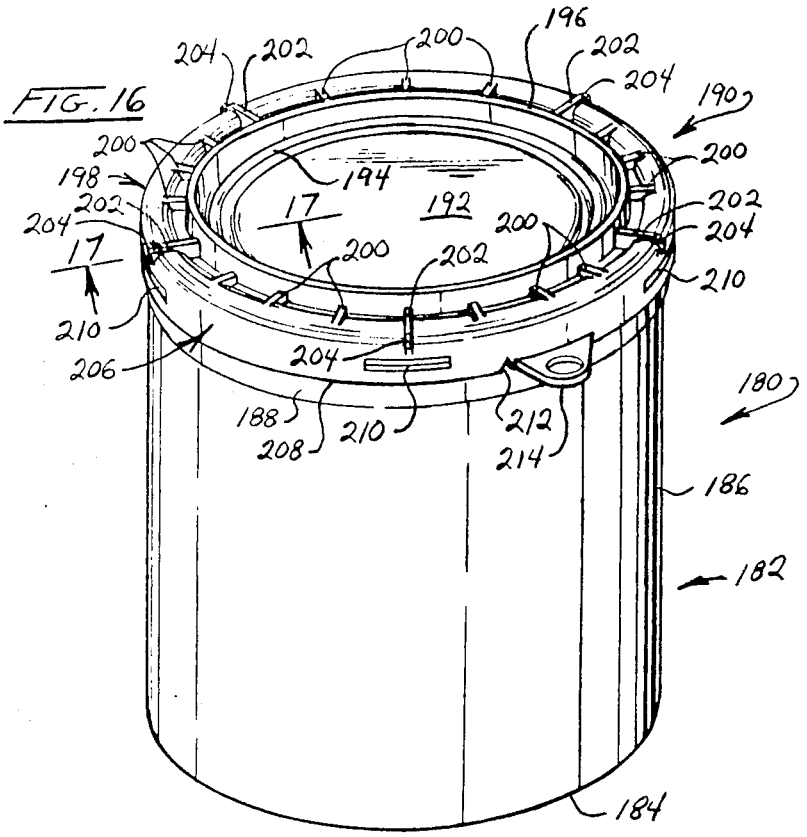
FIG. 16 is a perspective view of a lid and container assembly showing another embodiment of a lid structure particularly suited for use with drum type containers.

Looking to FIG. 16, an alternate embodiment of the lid structure of the invention intended for drum usage is revealed in general as assemblage 180. As before, the drum as represented in general at 182 includes a bottom portion 184 structured in the manner shown at 104–106 in FIG. 8. From the bottom portion 184, sidewalls 186 extend upwardly to a container rim structure including a chime 188. A discoidal lid represented generally at 190 fits over the rim structure of the drum 182 and incorporates, as before, primary and secondary latching features. The top portion of the lid 190 is structured identically as to that shown in conjunction with FIGS. 1 through 9 and, accordingly, top portion 192 is shown to extend to integrally formed undulations 194, whereupon the top 192 is configured having an upstanding centering rib 196 which is employed for drum stacking procedures. About the periphery of the drum extending inwardly from a lid rim portion represented generally at 198 are a first grouping of stiffeners 200 which, as before, provide both a stiffening function and serve to support the bottom portion of a next given drum where the drum-lid combination 180 is being stacked. Five additional stiffeners are shown at 202 which are symmetrically spaced about the container lid top portion 192 and serve the additional function of alignment for lid stacking by virtue of the incorporation therein of notches as at 204. The stiffeners 202 and notch 204 arrangement extends essentially to the outward surface of an integrally molded skirt assembly shown generally at 206 and extending downwardly over the rim structure of the drum 182 to a lower edge 208.

An interference lug assembly 210 is located within the skirt assembly 206 beneath each of the five stiffeners 202. Additionally, a starting notch 212 is formed in the bottom edge 208 of the skirt assembly 206 adjacent a manually graspable tear ring 214. As in the earlier embodiment, (FIG. 7) the notch 212 in tear ring 214 is arranged to cooperate with a parting groove to remove the primary latching assembly so as to initially open or remove the lid 190 from the drum 182 while providing for secondary latching closure thereafter.

Figure 17:
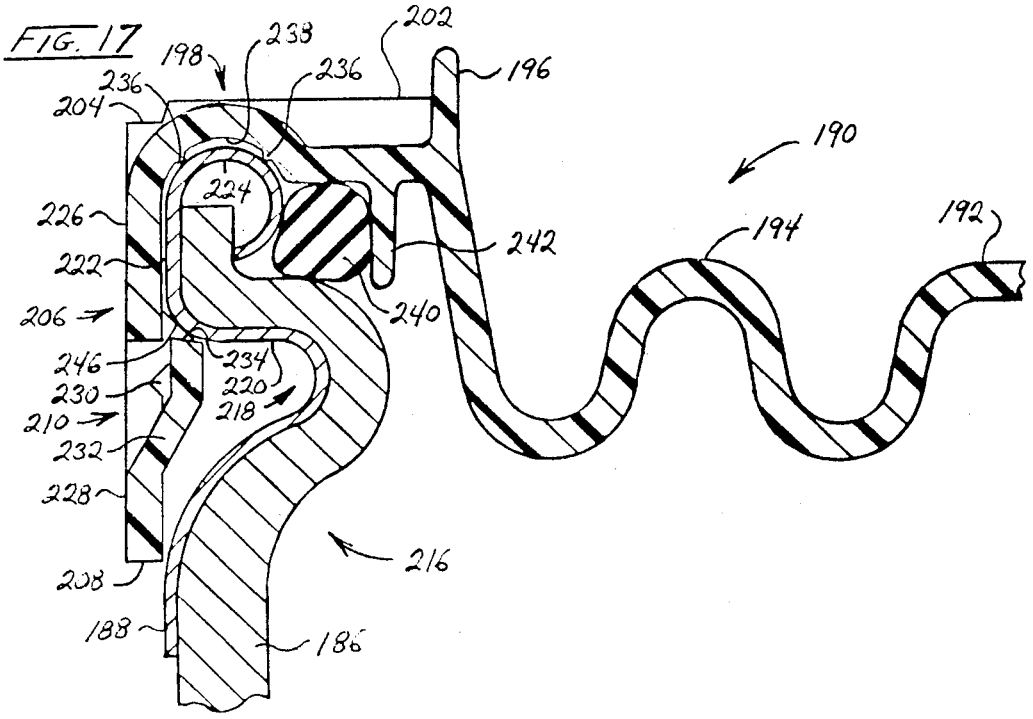
FIG. 17 is a partial sectional view of the lid and container assemblage of FIG. 16 taken through the plane 17—17 shown in the latter figure.

Referring to FIG. 17, the rim structure for the drum 182 is represented generally at 216 as including the metal chime 188 which is configured to define an inwardly extending engaging groove or region 218 having an upper contact surface 220. The chime then extends upwardly to provide an outwardly disposed side surface portion 222 which, in turn, extends to an upwardly disposed container rim bead 224. As in the earlier embodiment, the skirt assembly 206 is divided into an upper skirt portion 226 and lower skirt portion 228, these portions being separated and defined by a parting groove 230 extending along the entire inwardly disposed surface of the skirt assembly 206. The interference lug assemblies 210 may be observed to be integrally formed and contained within the lower skirt portion 228 and are configured having a compression section 232 which is integrally molded in an angularly inwardly oriented detent to provide a contact edge 234 which engages the upper contact surface 220 of groove 218 when lid 190 is positioned initially upon the drum rim structure 216. This forms the primary latching assembly. As is apparent, by pulling tear ring 214, this primary latching assembly is removed by tearing along parting groove 230. The assemblage 180 then has lid 190 retained in sealing position by a secondary latching assembly. In the latter regard, as before, the skirt assembly 206 is dimensioned so as to provide a press fit between the inner surface of its upper portion 226 and the side surface portion 222 of rim assembly 216. Sealing is also provided by the structure of the interior surface of rim 198 which, as before, is seen to contain continuous pressure or sealing lines or ridges 236. The rim 198 further is configured having an interior surface 238 which is bead conforming in structure so as to be nestable in seating adjacency with the upper surface of the rim bead 224. To enhance sealing, a gasket 240 is attached to the lid so as to be engageable with the inward surface of bead 224 and is shown, being retained by a retainer ridge 242. The secondary seal additionally contains a detent defining ridge 246 which is integrally molded with the upper skirt portion 226 just above the parting groove 230. So arranged, the lid 190 provides a secondary seal which permits the fascile repositioning and sealing of the lid on the drum 182 as well as fascile removal. Similar to the earlier figures, the spacing between the conforming interior surface of the secondary latching assembly is shown in exaggerated, spaced away fashion in the interest of clarity.

Stacking of the lids as at 190 is carried out, as before, by positioning the lower skirt edge 208 of one lid upon the stacking notch 204 of a lower disposed lid. Further, the undulations 194 provide the same function, as earlier described, of aiding in the maintenance of the primary and secondary seals where the rim assembly 216 may take on a permanent deformation due to dropping or the like. Drum stacking is carried out in the same manner as discussed in conjunction with FIG. 8, the sidewalls of an upper drum being aligned with the arrangement with the sidewalls of a next lower drum in the stacking assemblage and the stiffeners as at 200 and 202 providing stacking support.

Figure 18:
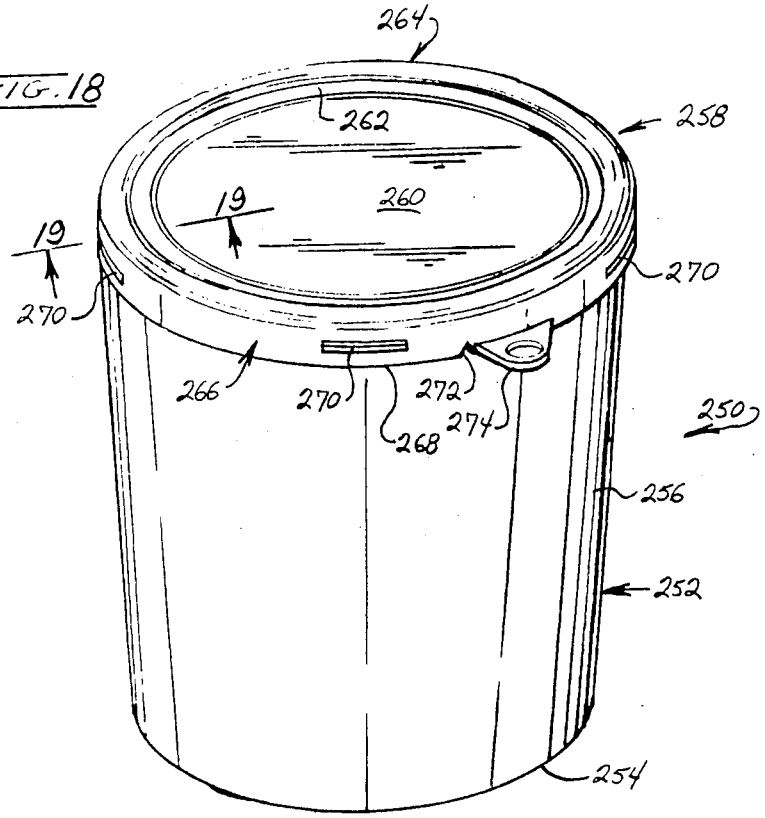
FIG. 18 is a perspective view of a container and lid assemblage of the invention showing another lid structure embodiment thereof suited for use with pail and tub type containers.

Referring to FIG. 18, an embodiment showing the structuring of the secondary latching features of the embodiment of FIGS. 16 and 17 is revealed for pail type structures. FIG. 18 shows the completed assemblage of pail and lid at 250 as including a frusto-conical pail 252 having a bottom portion 254 and sidewalls 256 and configured identically with pail 112 in FIG. 10. The lid of the assemblage 250 is represented in general at 258 and is shown to include a top portion 260 which extends to a peripherally disposed annular stacking trough 262 and an outwardly disposed lid rim structure shown generally at 264. Extending downwardly from the lid rim structure 264 is a skirt assembly shown generally at 266 which terminates in a lower edge 268. As in the drum embodiment, a series of interference lug assemblies 270 are positioned symmetrically about the skirt assembly 266 which serve to provide a primary latching feature. A starting groove is positioned within the lower edge 268 of skirt assembly 266 in juxtaposition to a tear ring 274. As before, (FIG. 7) by grasping the ring 274, the starting groove 272 will permit the removal of the primary latching assembly along a parting groove.

Figure 19:
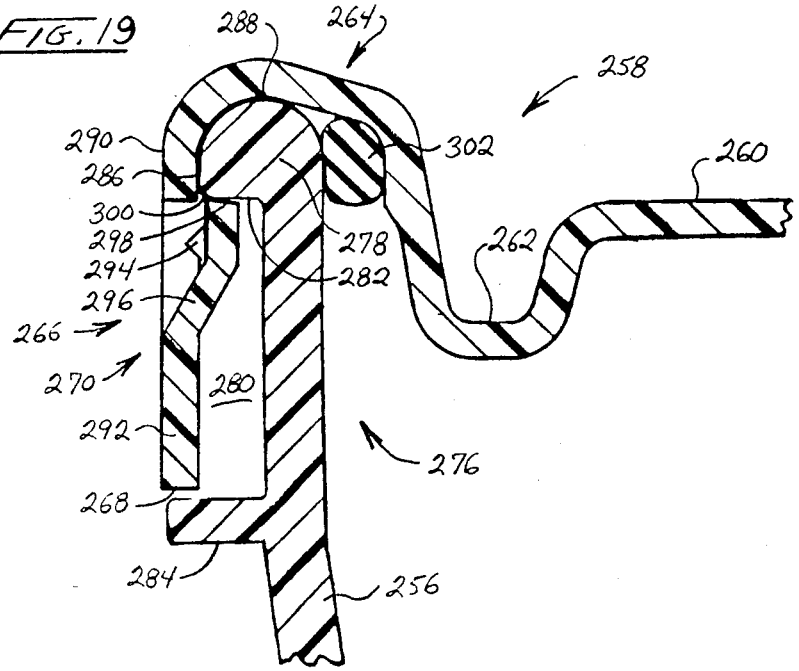
FIG. 19 is a partial sectional view of the lid and container assemblage of FIG. 18 taken through the plane 19—19 shown in the latter figure.

Looking additionally to FIG. 19, the rim assembly of the pail 252 is shown in general at 276 as including a rim bead 278 and an engaging groove 280 extending between an upper contact surface 282 and a rib 284. The bead 278 is formed having a side surface portion 286 and a top surface 288.

As before, the skirt assembly 266 includes an upper skirt portion 290 which is separated from a lower skirt portion 292 by a parting groove 294.

Similar to the embodiment of FIGS. 16 and 17, the primary latching assembly of the instant pail embodiment includes an interference lug assembly 270 which is formed having a compression section 296 integrally molded with the skirt assembly lower portion 292 and extending in detent fashion to a top contact surface 298 which engages the upper contact surface 282 of groove 280 in compressable abuttment upon the initial positioning of the lid 258 upon the pail 252.

The secondary latching assembly, as before, includes the upper skirt portion 290 which is configured having an interior surface of diametric extent assuring a close press fit with the outside surface 288 of rim 278. Additionally, a detent defining ridge 300 provides for a snap-on connection of the lid 258 with the upper contact surface 298. As before, the top surface of bead 278 resides in conforming nesting adjacency with the corresponding interior surface of rim 264. Further, a gasket 302 is positioned within the structure 264 to nest against the inwardly disposed surface of the rim bead 278. With the arrangement shown, a tamper evident feature is provided, however, that tamper evident feature is a portion of the primary latch itself. The embodiment of FIGS. 18 and 19 is stackable in the manner described in conjunction with FIG. 14 to facilitate retail display.

Since certain changes may be made in the above-described apparatus without departing from the scope of the invention herein involved, it is intended that all matter contained in the description thereof or show in in the accompanying drawings shall be interpreted as illustrative and not in a limiting sense.

I claim:

1. A molded lid for removable closure over a container having a bottom and sidewall extending upwardly therefrom to a top portion including a rim structure having an upwardly disposed rim bead, an outwardly disposed side surface portion and an inwardly extending engaging region formed inwardly of and below said rim bead and having an upper contact surface, comprising:

a lid top portion formed of resilient plastic material extensible across said container top portion to an outer periphery locatable adjacent said rim structure;

a skirt assembly integrally formed with said lid top portion and extending downwardly from said periphery to a lower edge locatable below said engaging region upper contact surface;

a primary latching assembly integrally formed with said skirt assembly and including:

a plurality of discrete lid lock pocket assemblies formed integrally with said skirt assembly and defining a lock chamber intermediate the inwardly disposed side of said skirt assembly and said container sidewall, an interference lug pivotally coupled with said skirt lower edge at a said lid lock pocket assembly for pivotal movement about said lower edge into said lock chamber into a securing orientation for deriving abuttable contact with said engaging region upper contact surface to effect substantially rigid compressive restraint between said pivotal coupling with said skirt lower edge and said contact surface abuttable contact, and resiliently deformable toward the inside surface of said skirt assembly when said lid skirt assembly is being positioned over said container rim structure, said skirt assembly including a parting groove extending thereabout to define upper and lower skirt portions and hand graspable means coupled with said skirt lower portion for effecting the manual removal of said lower skirt portion from along said parting groove including said primary locking assembly interference lugs;

a secondary latching assembly including:

a generally semi-cylindrically shaped lid rim disposed at the said lid top portion outer periphery, and having a bead conforming interior surface nestable in seating adjacency with said upwardly disposed container rim bead, and said upper skirt portion being configured having an internal dimension selected as less than the corresponding outside dimension of said container rim structure outwardly disposed side surface portion to effect a press fit therebetween.

2. The molded lid of claim 1 in which said secondary latching assembly includes a detent defining ridge formed integrally with said skirt assembly upper portion interior surface at a location for snap-on engagement with said rim structure engaging region.

3. The molded lid of claim 1 in which said lid top portion is configured having undulations therein inwardly disposed from and continuous about said lid top portion outer periphery and deformable in response to impact phenomena asserted in the vicinity of said outer periphery.

4. The molded lid of claim 3 in which each said lid top portion includes:

a centering rib integrally formed within said lid top portion intermediate said undulations and said outer periphery for locating the bottom of another said container in stacking relationship with said lid; and upstanding container stacking rib means substantially perpendicularly aligned with respect to said lid top portion outer periphery and extending intermediate said centering rib and said outer periphery for receiving the outwardly disposed region of said bottom of said other container located in stacking relationship wherein said sidewalls of each container are in mutually aligned weight transfer relationship.

5. The molded lid of claim 3 in which each said lid top portion includes:

a plurality of discrete upstanding stacking supports integrally formed with said lid top portion intermediate said undulations and said outer periphery, each having an upwardly disposed stacking support surface for receiving and supporting the bottom of another said container in stacking relationship with said lid.

6. The molded lid of claim 5 in which each said upstanding stacking support includes a centering lug inwardly disposed from said lid periphery and extending upwardly from said stacking support surface for locating the bottom of another said container in stacking alignment with said lid.

7. The molded lid of claim 1 in which said lid top portion includes upstanding lid stacking rib means substantially perpendicularly aligned with respect to said lid top portion outer periphery and notched at a location above and adjacent said skirt assembly for receiving the said skirt assembly lower edge of another said lid for effecting an aligned, stacking relationship therewith.

8. The molded lid of claim 7 in which each said lid stacking rib means is positioned upon said lid top portion over a said lid lock pocket assembly.

9. The molded lid of claim 1 in which said interference lug is configured having two discrete, spaced hinge attachments with said skirt assembly lower edge and further is formed having an arcuate cross-section extending between said hinged attachments.

10. The molded lid of claim 9 in which each said interference lug is integrally formed with said skirt assembly and said hinged attachment comprises a narrow fold region supporting said lug in a normally outwardly disposed orientation, said lug being pivotally movable about said fold region into an associated said lid lock pocket.

11. The molded lid of claim 1 in which said lid top portion includes a gasket affixed thereto at said outer periphery for contacting the inwardly disposed portion of said rim structure in sealing abutment when said lid is retaine dupon said container by said secondary latching assembly.

12. The molded lid of claim 1 in which said primary latching assembly interference lug includes retainer tab means fixed to and extending outwardly therefrom and retained intermediate the interior surface of said pocket assembly and said rim structure outwardly disposed side surface portion when said lid is secured to said container by said primary latching assembly for retaining said interference lug in said securing orientation.

13. The molded lid of claim 1 in which said primary latching assembly includes means defining an abutting detent connection intermediate said interference lug and said lower skirt portion when said lid is secured to said container by said primary latching assembly for transferring compressive stress developed between said interference lug and said engaging region upper contact surface into said lower skirt portion.

14. A lid for removable closure over a frusto-conically shaped container having a bottom including an annular seating portion, a sidewall extending upwardly therefrom to a top portion including a rim structure having an upwardly disposed rim bead, an outwardly disposed side surface portion of given diameter and an outwardly accessible engaging region below said rim bead having an upper contact surface, comprising:

a discoidal lid top portion formed of resilient plastic material extensible across said container top portion to an outer periphery locatable adjacent said rim structure;

a skirt assembly integrally formed with said lid top portion and extending downwardly from said periphery to a lower edge locatable below said engaging region upper contact surface;

a parting groove extending continuously about said skirt assembly to define upper and lower skirt portions;

hand graspable means coupled with said lower skirt portion for effecting the removal of said lower skirt portion while maintaining said skirt upper portion intact with said lid top portion;

a primary latching assembly integrally formed with said skirt assembly and including;

a plurality of discrete lid lock pocket assemblies formed integrally with said skirt assembly and defining a lock chamber intermediate the inwardly disposed side of said skirt assembly and said container sidewall top portion;

an interference lug coupled with said skirt lower portion at narrow fold regions at a said lid lock pocket assembly for pivotal movement about said fold region into said lock chamber and into a securing orientation deriving abuttable contact with said engaging region upper contact surface to effect substantially rigid restraint in compression between said fold region and said upper contact surface at said abuttable contact, and resiliently deformable toward the inside surface of said skirt assembly when said skirt assembly is being positioned over said container rim structure, each said interference lug being removable from said skirt assembly with removal of said skirt lower position;

a secondary latching assembly including:

a lid rim disposed at the said lid top portion outer periphery and having a bead conforming interior surface nestable in seating adjacency with said upwardly disposed container rim bead; and a detent defining ridge formed integrally with the interior surface of said skirt assembly upper portion at a location for snap-on engagement with said rim structure upper contact surface.

15. The lid of claim 14 in which said upper skirt portion is dimensioned having an internal diameter selected as less than said container rim structure given diameter to form a portion of said secondary latching assembly.

16. The lid of claim 14 in which said interference lug narrow fold regions are configured as two, discrete, spaced pivot attachments with said skirt lower edge and support said interference lug to which they are coupled outwardly from said lower skirt portion prior to said pivotal movement thereof.

17. The lid of claim 16 in which said interference lug is formed having a unidirectionally outwardly deformable cross-section intermediate said spaced pivot attachments.

18. The lid of claim 16 in which said primary latching assembly includes means defining an abutting detent connection intermediate said interference lug and said lower skirt portion when said lid is secured to said container by said primary latching assembly for transferring compressive stress developed between said interference lug and said engaging region upper contact surface into said lower skirt portion.

19. The lid of claim 14 including an annular stacking trough having a radius corresponding with said container bottom annular seating portion for effecting a nestable union therewith for stacking.

20. A lid for removable closure over a container having a bottom and sidewall extending upwardly therefrom to a top portion including a rim structure having an upwardly disposed rim bead, an outwardly disposed side surface portion and an inwardly extending engaging region formed inwardly of and below said rim bead and having an upper contact surface, comprising:

a lid top portion formed of resilient plastic material extensible across said container top portion to an outer periphery locatable adjacent said rim structure;

a skirt assembly integrally formed with said lid top portion and extending downwardly from said periphery to a lower edge locatable below said engaging region upper contact surface;

a parting groove extending continuously about said skirt assembly to define upper and lower skirt portions;

hand graspable means coupled with said lower skirt portion for effecting the removal of said lower skirt portion while maintaining said skirt upper portion intact with said lid top portion;

a primary latching assembly integrally formed with said skirt assembly and including:

a plurality of discrete, spaced interference lugs formed with and extending from said skirt lower portion for resilient movement into a securing orientation deriving abuttable contact with said engaging region upper contact surface to effect substantially rigid restraint in compression between said lower skirt portion and said upper contact surface at said abuttable contact, and resiliently deformable toward the inside surface of said skirt assembly when said skirt assembly is being positioned over said container rim structure, each said interference lug being removable from said skirt assembly with said skirt lower portion;

a secondary latching assembly including:

a lid rim disposed at the said lid top portion outer periphery and having a bead conforming interior surface nestable in seating adjacency with said upwardly disposed contaier rim bead, and a detent defining ridge formed integrally with the interior surface of said skirt assembly upper portion at a location for snap-on engagement with said rim structure upper contact surface.

21. The lid of claim 20 in which said upper skirt portion is dimensioned having an internal diameter selected as less than said container rim structure given diameter to form a portion of said secondary latching assembly.

22. The molded lid of claim 20 in which said lid top portion is configured having undulations therein inwardly disposed from and continuous about said lid top portion outer periphery and deformable in response to impact phenomena asserted in the vicinity of said outer periphery.

23. The molded lid of claim 20 in which each said lid top portion includes:

a centering rib integrally formed within said lid top portion intermediate said undulations and said outer periphery for locating the bottom of another said container in stacking relationship with said lid; and upstanding container stacking rib means substantially perpendicularly aligned with respect to said lid top portion outer periphery and extending intermediate said centering rib and said outer periphery for receiving the outwardly disposed region of said bottom of said other container located in stacking relationship wherein said sidewalls of each container are in mutually aligned weight transfer relationship.

24. The molded lid of claim 20 in which said lid top portion includes upstanding lid stacking rib means substantially perpendicularly aligned with respect to said lid top portion outer periphery and notched at a location above and adjacent said skirt assembly for receiving the said skirt assembly lower edge of another said lid for effecting an aligned, stacking relationship therewith.

* * * * *